United States Patent [19]

Stix

[11] 4,053,412

[45] Oct. 11, 1977

[54] COLLECTING DEVICE FOR A SWIMMING POOL

[76] Inventor: William Stix, 4637 Pershing, St. Louis, Mo. 63108

[21] Appl. No.: 649,924

[22] Filed: Jan. 19, 1976

[51] Int. Cl.[2] ..... E04H 3/16

[52] U.S. Cl. ..... 210/169; 15/1.7; 210/242 R

[58] Field of Search ..... 210/169, 242, DIG. 25; 15/1.7

[56] References Cited

U.S. PATENT DOCUMENTS

| | | | |
|---|---|---|---|
| 2,367,997 | 1/1945 | Chambers | 210/169 UX |
| 3,152,076 | 10/1964 | Krutzer | 210/169 |
| 3,244,284 | 4/1966 | Shaffer | 210/242 R |
| 3,625,364 | 12/1971 | La Cheme | 210/169 |
| 3,730,119 | 5/1973 | Budris et al. | 210/242 |
| 3,767,055 | 10/1973 | Harland | 210/242 |
| 3,774,767 | 11/1973 | Field | 210/169 |
| 3,860,518 | 1/1975 | Henricksen | 210/169 |

FOREIGN PATENT DOCUMENTS

| | | | |
|---|---|---|---|
| 590,252 | 1/1960 | Canada | 210/169 |

*Primary Examiner*—Theodore A. Granger
*Attorney, Agent, or Firm*—Rogers, Eilers & Howell

[57] ABSTRACT

A floating support defines an open area, and it removably holds a net adjacent that open area. That floating support holds the leading edge of that net below the surface of a circulating body of water in a swimming pool, but it holds the trailing edge of that net above that surface so objects which are floating on and moving with that body of water will move into and be held by that net. That net is light in weight, and it can be raised vertically from the floating support for emptying. Also, a floating barrier extends forwardly from that floating support to guide floating objects toward that floating support and to help provide an additional enclosed area, immediately ahead of that floating support, within which floating objects can be trapped.

8 Claims, 13 Drawing Figures

COLLECTING DEVICE FOR A SWIMMING POOL

BACKGROUND OF THE INVENTION

Leaves, twigs, bugs and some other objects which fall into swimming pools tend to float on the surface of the water for a number of hours before they become waterlogged and sink. Because many swimming pools are provided with equipment which causes the surface water to make full circuits of those swimming pools near their perimeters, that surface water carries leaves, twigs, bugs and other floating objects with it and brings them near the longitudinal sides of those pools. Various devices have been proposed to trap and hold or remove leaves, twigs, bugs and other objects which float on the water within swimming pools. Most of those devices which are in current use are built into the walls of the swimming pools, although other of those devices have been designed to float on the water in swimming pools. Some devices are used to gather or trap leaves, twigs, bugs and other objects after they have sunk to the bottom.

SUMMARY OF THE INVENTION

A floating support defines an open area, and it holds a removable net adjacent that open area. That floating support holds the leading edge of that net below the surface of a circulating body of water in a swimming pool, but it holds the trailing edge of that net above that surface so objects which are floating on and moving with that body of water will move into and be held by that net. That net is light in weight, and it can be raised vertically from the floating support for emptying. It is, therefore, an object of the present invention to provide a floating support which holds a removable net adjacent an open area thereof and which permits that net to be raised vertically for emptying.

The net provided by the present invention is relatively large, and hence can collect and hold large quantities of leaves, twigs, bugs and other objects which float on the water within a swimming pool. This is desirable, because it will help keep leaves, twigs, bugs and other objects from floating away after momentarily collecting adjacent that net--even when that net is not emptied at frequent intervals. It is, therefore, an object of the present invention to provide a floating support which removably holds a relatively-large net.

A floating barrier extends forwardly from the floating support to guide floating objects toward that floating support. That floating guide also creates a "harbor" which is bounded on one side by the barrier and on the opposite side by the near wall of the pool, and which guides leaves, twigs, bugs and other floating objects into the area occupied by the net. That harbor will keep leaves, twigs, bugs and other objects from floating away after momentarily collecting adjacent that floating support--even when neither the net nor the harbor is emptied at frequent intervals. That floating barrier is porous, so water can pass through it; and it is flexible or articulated, so it is easily handled and so it will conform to the surface of the water in a swimming pool. It is, therefore, an object of the present invention to provide a floating barrier which extends forwardly from a floating support to guide floating objects toward that floating support and to create a harbor to hold leaves, twigs, bugs and other floating objects adjacent that floating support—even when neither the net of that floating support nor the harbor is emptied at frequent intervals.

The net rests securely adjacent the open area defined by the floating support, and it does not have to be locked, pinned, tied or otherwise fastened in position adjacent that open area. As a result, that net is easily moved away from, and thereafter is returned to, its position adjacent that open area. Moreover, that net need not be tilted or turned as it is moved away from, and thereafter is returned to, its position adjacent that open area; and hence the contents of that net will not tend to spill out of that net during movement of that net. It is, therefore, an object of the present invention to provide a net which rests securely adjacent an open area defined by a floating support and which does not have to be locked, pinned, tied or otherwise fastened in position adjacent that open area.

Other and further objects and advantages of the present invention should become apparent from an examination of the drawing and accompanying description.

In the drawing and accompanying description several preferred embodiments of the present invention are shown and described but it is to be understood that the drawing and accompanying description are for the purpose of illustration only and do not limit the invention and that the invention will be defined by the appended claims.

DESCRIPTION OF THE PREFERRED EMBODIMENTS

Figure 1:
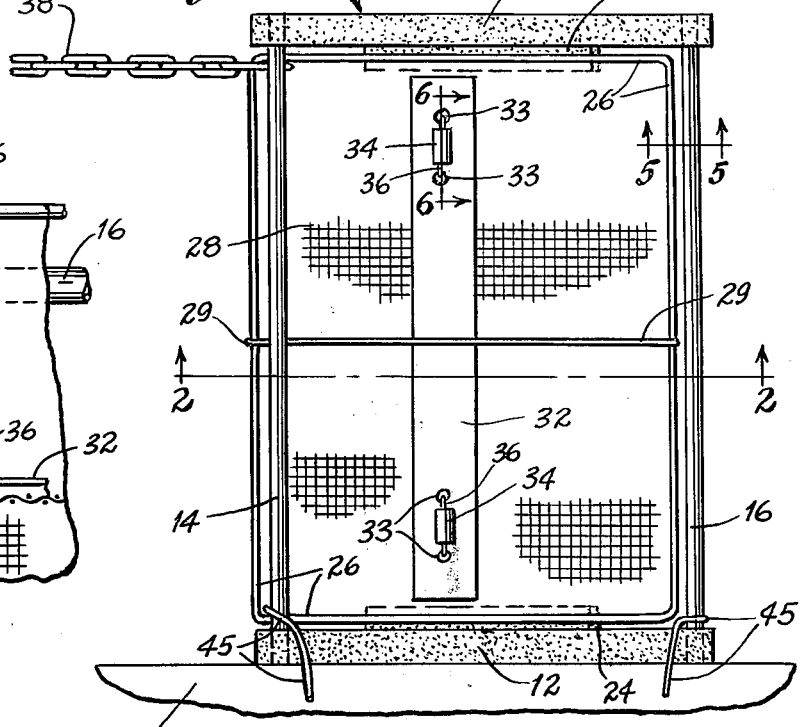
FIG. 1 is a broken plan view of one preferred embodiment of collecting device for a swimming pool which is made in accordance with the principles and teachings of the present invention.
Figure 3:
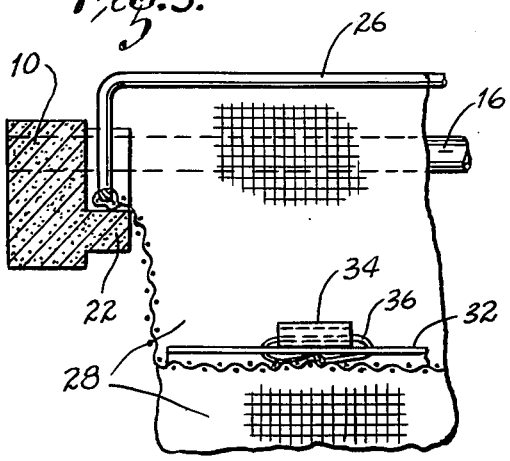
FIG. 3 is a sectional view, on a larger scale, through the collecting device of FIG. 1, and it is taken along the plane indicated by the line 3—3 in FIG. 2.

Referring to FIGS. 1–6 in detail, the numeral 9 generally denotes a floating support of one preferred embodiment of collecting device for a swimming pool which is made in accordance with the principles and teachings of the present invention. That floating support includes elongated, buoyant side members 10 and 12 which are held in spaced-apart, parallel relation by spacers 14 and 16. The side members 10 and 12 are made from light-weight material which is resistant to water, sun, heat and the like; and one such material is closed-cell, foam-type plastic material. The spacers 14 and 16 are light in weight, and they preferably are hollow tubes of light-weight plastic material. The numeral 18 denotes a fastener (which could be a staple) and which is secured to the inner surface of the side member 10 adjacent the leading edge of that side member but below the level of the spacer 14.

Figure 2:
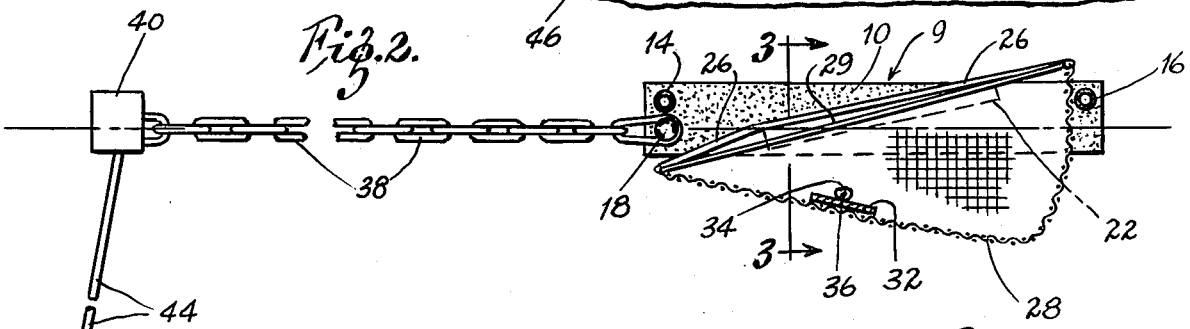
FIG. 2 is a broken sectional view through the collecting device of FIG. 1, and it is taken along the plane indicated by the line 2—2 in FIG. 1.
Figure 4:
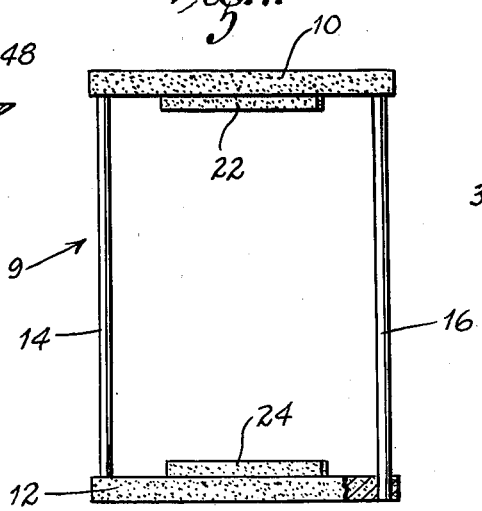
FIG. 4 is a partially sectioned, plan view, on a smaller scale, of the floating support of the collecting device of FIG. 1.

A ledge 22 is provided at the inner face of the side member 10, and the leading edge of that ledge is closed to the waterline but the trailing edge of that ledge is spaced above the waterline, as indicated particularly by FIG. 2. A similar ledge 24 is provided at the inner face of the side member 12, as indicated particularly by FIGS. 1 and 4. The ledges 22 and 24 are light in weight so they will not keep the floating support 9 from being buoyant. That floating support defines a generally rectangular open area.

Figure 5:
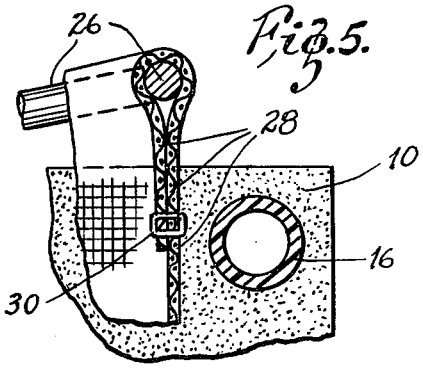
FIG. 5 is a sectional view, on a scale larger than that of FIG. 3, through part of the net of the collecting device of FIG. 1, and it is taken along the plane indicated by the line 5—5 in FIG. 1.
Figure 6:
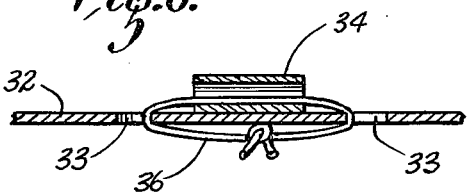
FIG. 6 is a sectional view, on a scale larger than that of FIG. 3, through part of the net of the collecting device of FIG. 1, and it is taken along the plane indicated by the line 6—6 in FIG. 1.

A large and preferably easily-flexed net 28 is dimensioned to fit easily within the open space defined by the floating support 9. As shown particularly by FIG. 1, the frame 26 of the net 28 fits between the confronting faces of the side members 10 and 12 and overlies, and is supported by, the ledges 22 and 24. As shown particularly by FIG. 2, the leading edge of the net 28 is below the waterline whereas the trailing edge of that net is well above that waterline. The frame 26 preferably is made from relatively rigid light-weight rod, tube strips, or bars or a combination of same. The net 28 has its edges secured to the four sides of the generally-rectangular frame 26; but, because that net is quite flexible, the center of that net depends downwardly from those sides, as shown particularly by FIGS. 2 and 3. The edges of the net 28 can be secured to the generally-rectangular frame 26 in a number of ways; and FIG. 5 shows one edge of that net folded over one side of the frame 26 and then bent down into parallelism with an adjacent portion of that net. A fastener 30 of standard and usual design, or stitching or an adhesive can be used to hold the adjacent portions of that net in engagement. Although various net materials could be used, it is preferable to use a net material which has openings therein that have transverse dimensions of less than one-quater of an inch. However, depending on the size of the floating objects which can be expected to fall into any particular swimming pool, net material having openings as small as one-fourteenth of an inch or as large as 1 inch could be used.

The numeral 29 denotes a length of cord or rope or strap which has the leading edge thereof secured to the leading edge of the frame 26 of the net 28 and which has the trailing end thereof secured to the trailing edge of that frame. That cord preferably will be taut at all times, and it can be used as a "handle" to facilitate lifting of the net 28, whenever that net is to be emptied.

The numeral 32 denotes a thin, flexible plate of water-resistant material; and that plate has small openings 33 therein. The numeral 34 denotes weights which are resistant to water and which are made in the form of tubes. Fasteners 36, in the form of short lengths of flexible material, extend through the weights 34 and through the openings 33 in the plate 32 and then are tied or fused. As a result, the weights 34 are secured to the plate 32. That plate can be flexed to permit easy insertion thereof within the generally-rectangular frame 26; and it will rest upon, and produce the desired concave configuration of, the bottom of net 28 below the surface of the water. That plate and the weights attached thereto will hold the bottom of the net 28 down in its full capacity position, and also will help urge the generally-rectangular frame 26 downwardly against the ledges 22 and 24.

The numeral 38 denotes a buoyant barrier in the form of a chain of light-weight plastic material; and hence that barrier can be described as being flexible or articulated. The rear end of that barrier is secured to the floating support 9 by the fastener 18 which is located at the front of the inner face of the side member 10. The forward end of the flexible barrier 38 is connected to a float 40. The numeral 42 denotes an anchor which rests upon the bottom 48 of a swimming pool; and an anchor line 44 inclines upwardly from that anchor to the float 40. Although the anchor line 44 inclines upwardly at a specific angle in FIG. 2, the inclination of that anchor line is not critical.

Lengths 45 of cord or rope have the inner ends thereof secured to the spacer 14 and 16 of the floating support 9, and have the outer ends thereof secured to a weight or weights, not shown, which rest upon the top of the side wall 46 of a swimming pool. Those lengths of cord or rope will coact with that weight or weights to hold that floating support adjacent a predetermined portion of that side wall despite the forces which wind and the circulating water in the swimming pool apply to that floating support. The weight or weights will preferably have low profiles, and preferably will be shaped so persons cannot stub their toes as their feet contact that weight or weights.

Once the floating support 9 has been secured in position adjacent a predetermined portion of the side wall 46, the anchor 42 and the anchor line 44 will be set in position to cause the float 40 to hold the forward end of the flexible barrier 38 forwardly of the forward end of the side member 10. That flexible barrier will act as a "boom" to guide leaves, twigs, bugs and other floating objects toward the floating support 9. Also, that floating barrier will coact with the side wall 46 of the swimming pool to constitute a harbor that will hold and confine any leaves, twigs, bugs and other floating objects that approach, but do not immediately enter, the floating support 9.

The open nature of the flexible barrier 38, due to its chain-like or perforated or porous construction, is desirable. Not only does that open nature reduce the weight of that flexible barrier, but it permits water to pass transversely through that flexible barrier while keeping leaves, twigs, bugs and other floating objects from doing so. As a result, if a large quantity of leaves, twigs, bugs and other floating objects were to come to rest in the area between the flexible barrier 38 and the side wall 46 of the swimming pool, the water which urged further leaves, twigs, bugs and other floating objects into that area could pass through that flexible barrier instead of being diverted outwardly around the leading edge of that flexible barrier.

Whenever the floating support 9 rests upon the water of the swimming pool, the barrier 38 and the connector 18 will be at the waterline but the spacers 14 and 16 will be located above the waterline. The frame 26 of the net 28 will rest upon the ledges 22 and 24, and the leading edge of that frame will be below the waterline. As a result, leaves, twigs, bugs and other floating objects, which are moved by the circulating water in the swimming pool, will pass over that leading edge and enter that net. As those leaves, twigs, bugs and other floating objects pass over the leading edge of the frame 26, they will pass under the spacer 14; and hence the floating support 9 will not hinder or impede the movement of leaves, twigs, bugs and other floating objects into the net 28. The circulating water will pass freely through the rear wall of the net 28, but that rear wall will intercept and hold any leaves, twigs, bugs or other floating objects.

The ledges 22 and 24 define a plane which is close to, but which is inclined to, the waterline; and the acute angles which are defined by the upper surfaces of those ledges and by the surface of the water are very small angles. Importantly, those angles are considerably smaller than the angle of rest; and hence it is not necessary to lock, pin, tie or otherwise fasten the net 28 to the floating support 9. Instead, that net can be securely held within that floating support merely by resting the sides of the frame 26 thereof on the ledges 22 and 24. The angle of rest of the net 28 will be relatively large, because the upper surfaces of the ledges 22 and 24 will have the irregularities therein which are characteristically present in the surfaces of foamtype plastic materials, because the porous nature of the net 28 will apply sizable frictional forces to those ledges, and because the rear portions of the sides of that net will droop downwardly into position behind the rear ends of those ledges. In the embodiment of collecting device of FIGS. 1–6, the ledges 22 and 24 are inclined to the waterline at angles of about 15 degrees.

In the embodiment of collecting device of FIGS. 1–6, the frame 26 has a long dimension of almost two and one-half feet and a short demension of slightly less than 2 feet. In addition, the rear portion of the net 28 depends downwardly about 1 foot from the trailing edge of the frame 26. The resulting large volume, of the space which is defined by the net 28, enables that net to intercept and hold large quantities of leaves, twigs, bugs and other floating objects; and hence frequent emptying of that net is not necessary.

It will be noted that the sides of the frame 26 are bent so the leading edge of that frame is displaced below the plane which is defined by the trailing edge and by the rear ends of the side of that frame. This is desirable, because it enables that leading edge to be located below the surface of the water even though the ledges 22 and 24 are disposed at very small angles to that surface. The disposition of those ledges at those shallow angles is desirable; because it permits the heights of the side members 10 and 12 to be quite short — being about four inches in one preferred embodiment of the present invention, and also because it maintains that frame 26 at an angle well below the angle of rest. However, if desired, the sides of the frame 26 could be straight and the inclinations of the ledges 22 and 24 could be increased, as long as those ledges continue to maintain the frame 26 at an angle well below the angle of rest.

Whenever it becomes desirable to empty the net 28, it is only necessary to grasp the cord 29 which is secured to the leading and trailing edges of the frame 26, to move that frame far enough rearward relative to the floating support 9 to move that leading edge rearward of the spacer 14, and then to lift that net vertically and away from that floating support. There is no need to tilt or turn the net 28 as it is removed from the floating support 9; and that net can be lifted vertically as it is moved away from that floating support. Consequently, no leaves, twigs, bugs or other objects need fall out of that net as it is removed from, and is lifted out of, the floating support 9. The net 28 will be inverted to empty it; and then the plate 32 can be replaced within that net. Thereafter that net can be moved into position above the open area which is defined by the floating support 9; and then the sides of the frame 26 can be rested upon the ledges 22 and 24. Thereupon, the leading edge of that frame can be moved forward through the space between the spacer 14 and the waterline until that edge is well below that waterline, as indicated by FIG. 2.

Figure 7:
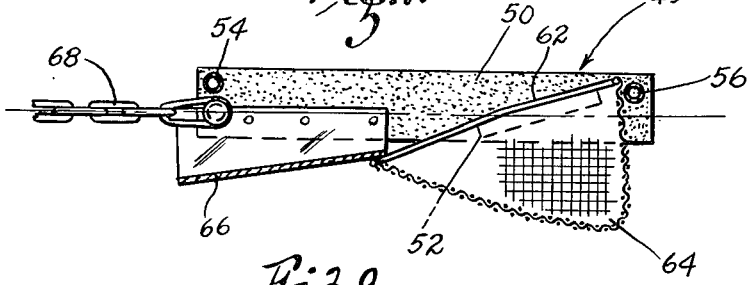
FIG. 7 is a vertical section through a second preferred embodiment of collecting device which is made in accordance with the principles and teachings of the present invention.
Figure 8:
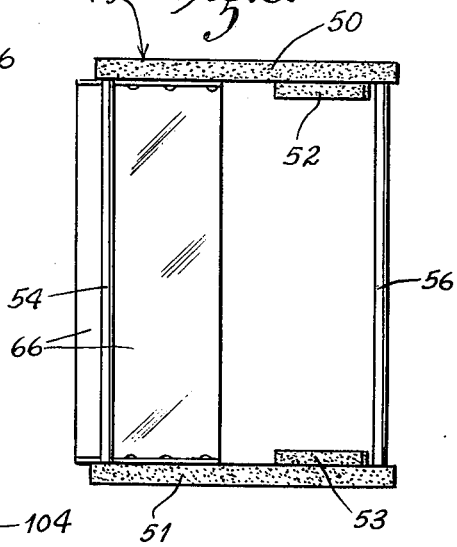
FIG. 8 is a plan view of the floating support of the collecting device shown in FIG. 7, and that view is on a scale smaller than that of FIG. 7.
Figure 9:
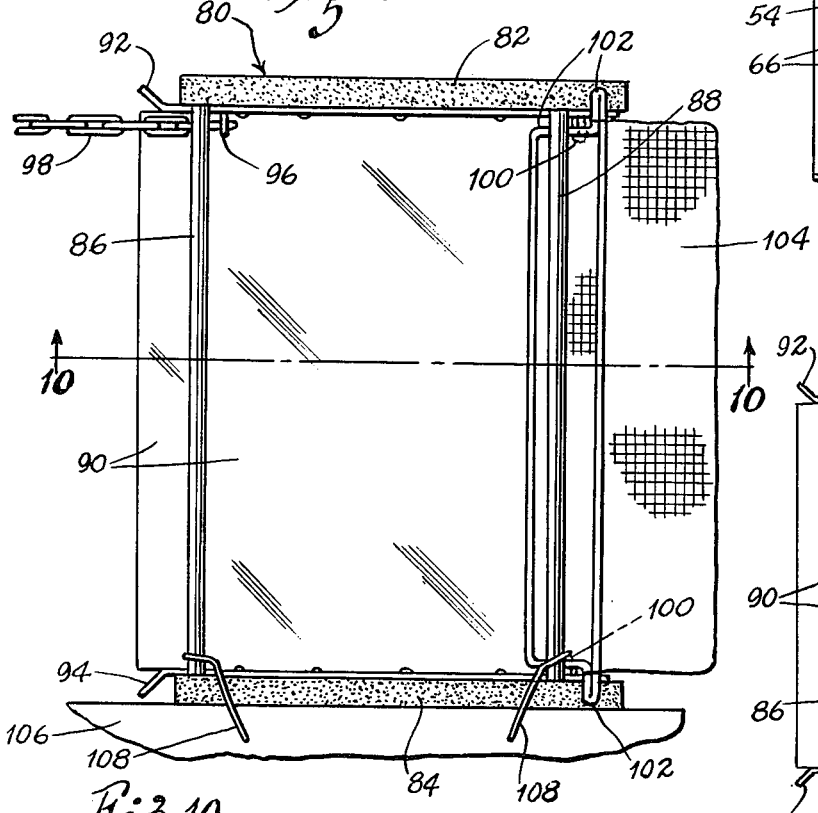
FIG. 9 is a broken plan view of a third preferred embodiment of collecting device which is made in accordance with the principles and teachings of the present invention.
Figure 11:
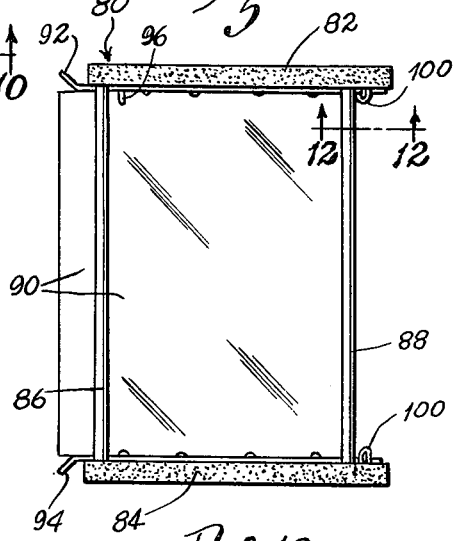
FIG. 11 is a plan view, on a scale smaller than that of FIG. 9, of the floating support of the collecting device of FIG. 9.

Referring particularly to FIGS. 7 and 8, the numeral 49 generally denotes the floating support of a second preferred embodiment of collecting device for a swimming pool which is made in accordance with the principles and teachings of the present invention. That floating support has side member 50 and 51 and spacers 54 and 56 that are similar to the side members 10 and 12 and to the spacers 14 and 16, respectively, of FIGS. 1–6. Ledges 52 and 53 are provided at the inner elongated surfaces of the side members 50 and 51, as shown particularly by FIG. 8. Those ledges coact with the surface of the water to define acute angles which are slightly larger than the acute angles which the water and the ledges 22 and 24 coact to define. However, the acute angles which are defined by the water and by the ledges 52 and 53 are very small angles and are considerably smaller than the angle of rest.

The floating support 49 defines a large, generally rectangular open area which accommodates a net 64 that has a generally-rectangular frame 62. The net 64 is shorter, relative to the floating support 49, than the net 28 is to the floating support 9. However, that net is large enough to collect and hold large quantities of leaves, twigs, bugs and other objects.

Although the angles at which the ledges 52 and 53 are disposed are greater than the angles at which the ledges 22 and 24 are disposed, the shorter length of the frame 62 makes it desirable to bend the sides of that frame, as shown by FIG. 7. However, if desired, the sides of that frame could be left straight if the ledges 53 and 54 were disposed at even greater angles. In any event, the angles at which those ledges are disposed should be below the angle of rest of the net 64.

The numeral 66 denotes a partial bottom for the floating support 49; and that partial bottom can be imperforate as shown, or it can be made with perforations thereto. Preferably, that partial bottom will be made of flexible mesh so the floating support 49 can be packaged with a space no higher than the height of the side member 50. The partial bottom 66 has sides that are secured to the elongated inner surfaces of the side members 50 and 51. As indicated particularly by FIG. 7, both the leading and the trailing edges of that plate-like partial bottom are disposed below the waterline; but that leading edge is disposed further below that waterline than is that trailing edge. The trailing edge of the plate-like partial bottom 66 overlies the leading edge of the frame 62 of the net 64, as indicated particularly by FIG. 7. If desired, the leading edge of the frame 62 could be rested upon the trailing edge of the partial bottom 66. The numeral 68 denotes a flexible barrier which can be identical to the flexible barrier 38 of FIGS. 1–6.

The partial bottom 66 makes it possible to make the net 64 smaller, and hence less expensive and lighter in weight, than the net 28. Also, that partial bottom will serve as an inclined plane to guide any partially-submerged leaf, twig, bug or other object into the net 64. Further, in any swimming pool where the circulation of the water was sufficiently rapid to enable that water to tend to bow or raise the bottom of the net 64 upwardly, the partial bottom 66 would minimize the tendency of the water to bow or raise that partial bottom. As a result, the net 64 can assume and retain the configuration shown by FIG. 7 without any need of a weighted plate 32. If desired, of course, such a weighted plate could be disposed within the net 64.

Whenever it becomes desirable to empty the net 64, it is only necessary to grasp a length, not shown, of cord or rope which is secured to the leading and trailing edges of the frame 62, to move that frame far enough rearward relative to the floating support 49 to dispose the leading edge of that frame rearward of the partial bottom 66, and then to lift that net vertically and away from that floating support. That length of cord or rope would be similar to, but shorter than, the length 29 of cord or rope in FIG. 1. There is no need to tilt or turn the net 64 as it is removed from the floating support 49; and that net can be lifted vertically as it is moved away from that floating support. Consequently, no leaves, twigs, bugs or other objects need fall out of that net as it is removed from, and is moved upwardly away from, the floating support 49. The net 64 will be inverted to empty it, and thereafter that net can be moved into position immediately above the open area which is defined by the floating support. The sides of the frame 62 can then be rested upon the ledges 52 and 53; and thereupon the leading edge of the frame can be moved forward into position beneath the trailing edge of the partial bottom 66, as indicated by FIG. 7.

Figure 10:
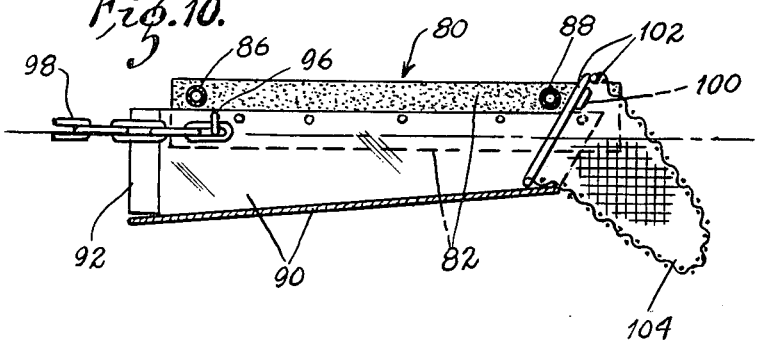
FIG. 10 is a sectional view through the collecting device of FIG. 9, and it is taken along the plane indicated by the line 10—10 in FIG. 9.
Figure 12:
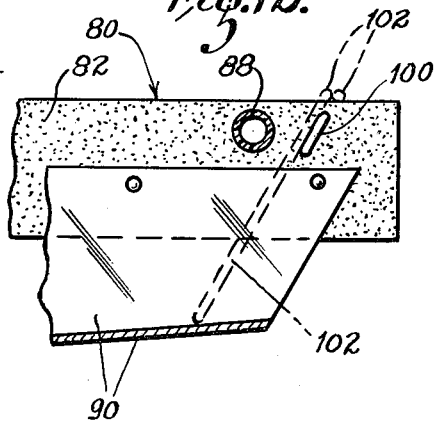
FIG. 12 is a sectional view, on a scale larger than that of FIG. 9, through a portion of the floating support shown in FIG. 11, and it is taken along the plane indicated by the line 12—12 in FIG. 11.
Figure 13:
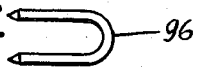
FIG. 13 is a side elevational view, on the scale of FIG. 12, of one of the staples used in the collecting device of FIG. 9.

Referring particularly to FIGS. 9–13, the numeral 80 generally denotes the floating support of a third preferred embodiment of collecting device for a swimming pool which is made in accordance with the principles and teachings of the present invention. That floating support has side members 82 and 84 and spacers 86 and 88 that are similar to the side members 10 and 12 and to the spacers 14 and 16, respectively, of FIGS. 1–6. The numeral 90 denotes a bottom for the floating support 80, and that bottom can be imperforate as shown, or it can be made with perforations therein. Preferably, that bottom will be made of flexible mesh so the floating support can be packaged within a space no higher than the height of the side member 82. The bottom 90 has sides that are secured to the elongated inner faces of the side members 82 and 84. If the bottom 90 is made from a stiff material, flanges 92 and 94 can be provided at the leading edges of the sides thereof which incline outwardly from those leading edges. As indicated particularly by FIGS. 9 and 11, those flanges are disposed forwardly of, but are partially coextensive with, the leading edges of the side members 82 and 84, respectively. Both the leading and trailing edges of the bottom 90 are disposed below the waterline, as shown by FIG. 10.

The numeral 96 denotes a staple which has one of the legs thereof passing through the rearmost link of a chain-link flexible barrier 98. The legs of that staple extend into the side member 82 of the supporting float 80, and thereby secure that flexible barrier to that floating support. That flexible barrier preferably is identical to the flexible barrier 38.

The rear portions of the side members 82 and 84 and the rear portion of the bottom 90 coact to define an open area. The numeral 100 denotes two ledges or guides which are located adjacent the rear portions of the inner faces of the side members 82 and 84 of the floating support 80. Those ledges or guides can be molded intergally with or affixed to those side members, or they can be made as staples which can be pressed into the inner faces of those side members. Those ledges or guides are located within, but do not appreciably obstruct, the open area at the rear of the floating support 80. As indicated particularly by FIG. 10, those ledges or guides are not only disposed rearward of the spacer 88, but they are disposed close to the level of that spacer. Furthermore, as shown by FIG. 10, those ledges or guides are inclined to the vertical, and they coact to define a plane which inclines downward and forward toward the bottom 90 of the floating support 80.

The ledges or guides 100 are spaced far enough rearwardly of the spacer 88 to permit free insertion and removal of the frame 102 of a net 104. That frame is rectangular; and, as indicated particularly by FIG. 9, it has re-entrant, outwardly-projecting portions adjacent the top thereof which overlie the upper surfaces of the side members 82 and 84. That frame is dimensioned so those re-entrant portions rest upon the upper surfaces of those side members while the bottom of that frame rests upon the bottom 90 of the floating support 80. The net 104 is disposed within the open area at the rear of the floating support 80; but the major portion of that net is rearwardly of the bottom 90 and of the rear faces of the side members 82 and 84, as shown particularly by FIGS. 9 and 10. Also, the bottom of that net extends an appreciable distance downwardly below the bottom 90. Whenever the frame 102 is assembled with the floating support 80, the plane which is defined by the rear face of that frame coacts with the surface of the water to define an acute angle. As shown by FIG. 10, that angle is considerably larger than 45 °.

The numeral 106 denotes a side wall of a swimming pool, and the floating support 80 is shown adjacent that side wall. The numeral 108 denotes lengths of cord or rope which are secured to the spacers 86 and 88 and which extend to weights, not shown, which will hold that floating support adjacent the side wall 106.

The substantially full length bottom 90 makes it possible for the net 104 to be smaller, and hence less expensive and more conveniently handled, than the net 28. Also, where that bottom is made of stiff material, it will serve as an inclined plane to guide any partially-submerged leaf, twig, bug or other object to the leading edge of the frame 102 of the net 104. Further, in any swimming pool where the circulation of the water was sufficiently rapid to enable that water to tend to bow or raise the bottom of the net 104, a stiff bottom 90 would limit the tendency of that water to bow or raise that bottom of that net. Where the bottom 90 is made from readily flexible mesh, weights can be attached to the lower edges of the sides of that bottom to cause that bottom to assume the configuration shown by FIGS. 9–12.

Whenever it becomes necessary to empty the net 104, it is only necessary to grasp the frame 102, to move that frame upward and rearward relative to the floating support 80, and then to lift that net vertically upward and away from that floating support. There is no need to tilt or turn the net 104 as it is removed from the floating support 80; and that net can be moved vertically upward as it is moved away from that floating support. Consequently, no leaves, twigs, bugs or other objects need fall out of that net as it is removed from, and is moved upward away from, the supporting support 80. The net 104 can, after it has been emptied, be moved into a position wherein the lower edge of the frame 102 is in register with the space which is defined by the spacer 88 and the ledges or guides 100. Thereafter, that frame can be moved downward through that space until the lower edge of that frame rests upon the bottom 90 of the floating support 80. At such time, the engagements between the re-entrant projections on the frame 102 and the upper surfaces of the side members 82 and 84, the engagements between that frame and the ledges or guides 100, the engagements between that frame and the bottom 90, and the engagements between the ledges or guides 100 and the forward portions of the sides of the net 104 will firmly support that frame, and yet will permit easy and simple removal of that frame and of that net from the floating support 80.

If desired, the flexible barrier 38, 68 or 98 could be disconnected from the floating support 9, 49 or 80; and the free end of a long, light-weight rod or pole could be connected to that floating support. That rod or pole could then be used to tow the collecting device of FIGS. 1–6, of FIGS. 7 and 8, or of FIGS. 9–13 around the surface of the water in the swimming pool to collect leaves, twigs, bugs or other objects floating on that water.

The floating supports of the several preferred embodiments of collecting devices of the present invention will rest upon the surface of the water as they collect and hold leaves, twigs, bugs and other floating objects. Also, those floating supports will rest upon the surface of the water as the nets are moved into position where they are held by those floating supports, and as those nets are moved away from those floating supports. As a result, all the user of the swimming pool has to lift and move is the net and its frame.

The floating supports will remain at the surface of the water, irrespective of the level at which that surface is kept. If the level of the water in a swimming pool is permitted to change substantially, the lengths of cord or rope which connect those floating supports to weights, not shown, will, of course, be suitably lengthened or shortened to hold those floating supports adjacent a side wall of that swimming pool. However, slight variations in the water level will not require any changes in the lengths of cord or rope, because the floating supports will automatically respond to the circulating water and to the lengths of cord or rope to assume positions wherein they abut the side walls of the swimming pools. Consequently, each of the preferred embodiments of collecting devices will effectively remove leaves, twigs, bugs and other floating objects from the surface of the water, even if the level of that surface is permitted to move up or down from its normal, intended position.

The floating supports of the present invention are made sufficiently wide to accommodate and hold nets that can receive and hold large quantities of leaves, twigs, bugs and other floating objects. As pointed out hereinbefore, one embodiment of frame 26 has a width of almost two and a half feet. Further, each of the flexible barriers 38, 68 and 98 which extends forwardly from the floating supports will, in the event the user of the swimming pool fails to empty the net when it becomes filled, coact with the adjacent side wall of that swimming pool to form a harbor which will confine additional leaves, twigs, bugs and other floating objects that would, except for the fact that the surface of the area defined by the floating support is filled, pass into and be held in that area. Such additional leaves, twigs, bugs and other floating objects could easily be swept by hand into the area defined by the floating support, since the leaves already there would be response to such sweeping become more tightly packed or could be lifted out of the space between the flexible barrier and the adjacent side wall of the swimming pool, whereupon the net could be lifted and emptied. Without the flexible barrier, if the surface of the area defined by the floating support is already filled with leaves, twigs, bugs, and other floating objects, the current at the surface tends to alter its direction and to flow around, rather than into, the area defined by the floating support, thus frustrating the further collection of leaves in that area. Importantly, therefore, the flexible barrier prevents or largely inhibits such alteration of the direction of the current, and thereby provides both a directional guide and an additional collecting basin for the newly-arriving leaves, twigs, bugs and other objects.

In receiving and holding leaves, twigs, bugs, and other objects that float on the surface of the water, the present invention helps keep the water in the swimming pool clean and clear. It is especially useful in times, such as early spring when there is heavy fall of tree blossoms, in those periods of summer when myriad seeds and pods fall from trees, and in autumn when there can be avalanches of leaves drifting or falling into a pool. Without the present invention, the amount of debris which finds its way into the pool at such times overwhelms smaller collecting devices, with the result that the uncollected debris sinks to the bottom. Moreover, in many instances, the filtering system of the pool becomes clogged and the motor which pumps water through the system becomes overloaded. Further, in periods of heavy debris accumulation, the present invention will enable the pool owner to screen or divert water flow from any inadequately sized debris collector, thereby preventing clogging of the filtration circuit and overload on the pump motor. The present invention, moreover, will greatly diminish the time and effort needed to clean the bottom of the pool.

If desired, the barriers 38, 68 and 98 could be disconnected from the floating supports during any periods when only limited numbers of leaves, twigs, bugs and other objects fall into the swimming pool. Those barriers should, however, be re-connected to those floating supports in the spring and fall of the year.

The nets 28, 64 and 104 are sack-like in configuration, and hence none of them constitutes a simple rectangle when it is spread flat. To effect the cost savings which the use of a simple rectangle of mesh would afford, each of the nets 28, 64 and 104 could be made from three elements: a rectangular piece of mesh which would constitute the bottom of the net and two side pieces of generally triangular form. If those side pieces were made so they were stiff they could be flanged at their upper edges to rest on the ledges of the floating supports. If those side pieces were not made stiff, they could be attached to bars or rods which would rest on those ledges. In either case, the rectangular piece of mesh would extend between the lower edges of the two side pieces and be affixed thereto by fusing, stitching, adhering, or clamping processes.

The collecting device of FIGS. 9–12 is provided with an elongated bottom 90; and that bottom can help confine leaves, twigs, bugs and other objects which would be unable to enter the net 104 if that net had become filled and had not been emptied. If desired, as where the collecting device of FIGS. 9–12 was to be used in a small swimming pool, the side members 82 and 84 could be shortened and the bottom 90 could be shortened or practically eliminated. In the latter event, suitable stops would be provided which would extend downwardly from the side members 82 and 84 to position and support the bottom of the frame 102 of the net 104.

The ledges 22 and 24 in FIGS. 1–4 and the ledges 52 and 53 in FIGS. 7 and 8 are very useful and desirable. Those ledges can be made integral with, or secured to, the inner surfaces of the side members of FIGS. 1–4, 7 and 8. If desired, spaced projections or other supporting members could be substituted for the ledges 22 and 24 or for the ledges 52 and 53.

Whereas the drawing and accompanying description have shown and described three preferred embodiments of the present invention, it should be apparent to those skilled in the art that various changes may be made in the form of the invention without affecting the scope thereof.

What I claim is:

1. Apparatus for collecting debris floating upon the surface of a body of water in a swimming pool with a water inlet located in an upper portion of a wall thereof which causes water entering said swimming pool through said inlet to cause the water at that surface to flow continuously through a predetermined path that is substantially parallel to a section of one wall of said swimming pool, the flowing water thereby carrying said debris along said predetermined path and hence adjacent to said pool wall section, said apparatus comprising float means for supporting a readily removable net, said float means comprising spaced-apart longitudinal floats with the ends of said floats connected by first and second elongated members constructed and arranged to define an open rectangular area defined by said elongated members and said floats, said float means having spaced-apart frame-supporting surfaces thereon, means for flexibly connecting one of said elongated floats with its longitudinal axis parallel to the longitudinal axis of said pool wall section and hence substantially parallel to said predetermined path, while holding said float means substantially stationary relative to said pool wall section and substantially stationary relative to said flowing water, rigid frame means removably supported by said spaced-apart frame-supporting surfaces on said float means, said frame means being constructed and arranged to be approximately the same rectangular shape as said open rectangular area, a flexible net supported by said frame means, said net having a downwardly-extending shape defined by a bottom wall, opposed side walls, and a rear wall, an edge of said bottom wall supported by the leading edge of said frame means, said bottom wall depending downwardly from the extending below the level of said leading edge of said frame means, an upper edge of said rear wall supported by the trailing edge of said frame means, said net having a capacity greater than the horizontal projection of said frame means multiplied by the distance between said water surface and the lower surface of said leading edge of said frame means, said float means and said frame means being free of interacting fasteners whereby said frame means and said net can easily be lifted upwardly from said float means while said float means continues to float on said water, and said longitudinal floats and said elongated members leaving the front and the top of said open rectangular area substantially unobstructed at all times to permit unobstructed entry of said floating debris into, and to permit the unobstructed substantially-vertical separating movement of said frame means and said net from, said float means.

2. Apparatus for collecting floating debris as claimed in claim 1 wherein said float means has a bottom-like means disposed ahead of said frame means, wherein said bottom-like means has both the leading and trailing edges thereof disposed below said water surface, wherein said leading edge of said bottom-like means is further below said water surface than is said trailing edge of said bottom-like means, and wherein said frame means has a leading edge which is immediately adjacent said trailing edge of said bottom-like means, whereby said bottom-like means can underlie partially-submerged debris and guide said partially-submerged debris upwardly toward said leading edge of said frame means.

3. Apparatus for collecting floating debris as claimed in claim 1 wherein said frame-supporting surfaces on said float means hold the sides of said frame means at shollow angles to said water surface, and wherein the sides of said frame means are bent to dispose the leading edge of said frame means below said water surface, and wherein the trailing edges of said sides of said frame means are disposed above said water surface because said frame-supporting surfaces hold said sides of said frame means disposed at said shallow angles to said water surface.

4. Apparatus for collecting floating debris as claimed in claim 1 wherein said frame means is releasably held adjacent the rear of said float means and permits a portion of said net to extend rearwardly beyond the rear of said float means, and wherein said portion of said net also extends downwardly below the level of the bottom of said float means.

5. Apparatus for collecting debris floating upon the surface of a body of water in a swimming pool with a water inlet located in an upper portion of a wall thereof which causes water entering said swimming pool through said inlet to cause the water at that surface to flow continuously through a predetermined path that is substantially parallel to a section of one wall of said swimming pool, the flowing water thereby carrying said debris along said predetermined path and hence adjacent to said pool wall section, said apparatus comprising float means for supporting a readily removable net, said float means comprising spaced-apart longitudinal floats with the ends of said floats connected by first and second elongated members constructed and arranged to define an open rectangular area defined by said elongated members and said floats, said float means having spaced-apart frame-supporting surfaces thereon, means for flexibly connecting one of said elongated floats with its longitudinal axis parallel to the longitudinal axis of said pool wall section and hence substantially parallel to said predetermined path, while holding said float means substantially stationary relative to said pool wall section and substantially stationary relative to said flowing water, rigid frame means removably supported by said spaced-apart frame-supporting surfaces on said float means, said frame means being constructed and arranged to be approximately the same rectangular shape as said open rectangular area, a flexible net supported by said frame means, said net having a downwardly-extending shape defined by a bottom wall, opposed side walls, and a rear wall, an edge of said bottom wall supported by the leading edge of said frame means, said bottom wall depending downwardly from and extending below the level of said leading edge of said frame means, an upper edge of said rear wall supported by the trailing edge of said frame means, said net having a capacity greater than the horizontal projection of said frame means multiplied by the distance between said water surface and the lower surface of said leading edge of said frame means, said float means and said frame means being free of interacting fasteners whereby said frame means and said net can easily be lifted upwardly from said float means while said float means continues to float on said water, and said longitudinal floats and said elongated members leaving the front and the top of said open rectangular area substantially unobstructed at all times to permit unobstructed entry of said floating debris into, and to permit the unobstructed substantially-vertical separating movement of said frame means and said net from, said float means, said spaced-apart frame-supporting surfaces being inclined to said water surface, said spaced-apart frame-supporting surfaces coacting with said water surface to subtend angles that are small acute angles and that are smaller than the angle of rest, said frame means resting upon said spaced-apart frame-supporting surfaces, whereby said spaced-apart frame-supporting surfaces hold said frame means inclined to said water surface to said leading edge of said frame means is below said water surface but a rearwardly-displaced portion of said frame means is above said water surface.

6. Apparatus for collecting debris floating upon the surface of a body of water in a swimming pool with a water inlet located in an upper portion of a wall thereof which causes water entering said swimming pool through said inlet to cause the water at that surface to flow continuously through a predetermined path that is substantially parallel to a section of one wall of said swimming pool, the flowing water thereby carrying said debris along said predetermined path and hence adjacent to said pool wall section, said apparatus comprising float means for supporting a readily removable net, said float means comprising spaced-apart longitudinal floats with the ends of said floats connected by first and second elongated members constructed and arranged to define an open rectangular area defined by said elongated members and said floats, said float means having spaced-apart frame-supporting surfaces thereon, means for flexibly connecting one of said elongated floats with its longitudinal axis parallel to the longitudinal axis of said pool wall section and hence substantially parallel to said predetermined path, while holding said float means substantially stationary relative to said pool wall section and substantially stationary relative to said flowing water, rigid frame means removably supported by said spaced-apart frame-supporting surfaces on said float means, said frame means being constructed and arranged to be approximately the same rectangular shape as said open rectangular area, a flexible net supported by said frame means, said net having a downwardly-extending shape defined by a bottom wall, opposed side walls, and a rear wall, an edge of said bottom wall supported by the leading edge of said frame means, said bottom wall depending downwardly from and extending below the level of said leading edge of said frame means, an upper edge of said rear wall supported by the trailing edge of said frame means, said net having a capacity greater than the horizontal projection of said frame means multiplied by the distance between said water surface and the lower surface of said leading edge of said frame means, said float means and said frame means being free of interacting fasteners whereby said frame means and said net can easily be lifted upwardly from said float means while said float means continues to float on said water, and said longitudinal floats and said elongated members leaving the front and the top of said open rectangular area substantially unobstructed at all times to permit unonbstructed entry of said floating debris into, and to permit the unobstructed substantially-vertical separating movement of said frame means and said net from, said float means, and an elongated floating barrier which is secured to said float means at a point which is displaced outwardly of said one elongated float and hence is displaced outwardly of said pool wall section, said elongated floating barrier extending forwardly of said float means to guide said debris toward said front of said open rectangular area and to coact with said pool wall section to define a harbor for holding additional debris.

7. Apparatus for collecting floating debris as claimed in claim 6 wherein said elongated floating barrier is flexible, wherein a holding means which is located in advance of said float means is connected to said elongated floating barrier adjacent the leading edge of said elongated floating barrier to hold said elongated floating barrier extended forwardly of said float means, and wherein said floating barrier is porous to permit water to pass transversely through said floating barrier.

8. Apparatus for collecting debris floating upon the surface of a body of water in swimming pool with a water inlet located in an upper portion of a wall thereof which causes water entering said swimming pool through said inlet to cause the water at that surface to flow continuously through a predetermined path that is substantially parallel to a section of one wall of said swimming pool, the flowing water thereby carrying said debris along said predetermined path and hence adjacent to said pool wall section, said apparatus comprising float means for supporting a readily removable net, said float means comprising spaced-apart longitudinal floats with the ends of said floats connected by first and second elongated members constructed and arranged to define an open rectangular area defined by said elongated members and said floats, said float means having spaced-apart frame-supporting surfaces thereon, means for flexibly connecting one of said elongated floats with its longitudinal axis parallel to the longitudinal axis of said pool wall section and hence substantially parallel to said predetermined path, while holding said float means substantially stationary relative to said pool wall section and substantially stationary relative to said flowing water, rigid frame means removably supported by said spaced-apart frame-supporting surfaces on said float means, said frame means being constructed and arranged to be approximately the same rectangular shape as said open rectangular area, a flexible net supported by said frame means, said net having a downwardly-extending shape defined by a bottom wall, opposed side walls, and a rear wall, an edge of said bottom wall supported by the leading edge of said frame means, said bottom wall depending downwardly from and extending below the level of said leading edge of said frame means, an upper edge of said rear wall supported by the trailing edge of said frame means, said net having a capacity greater than the horizontal projection of said frame means multiplied by the distance between said water surface and the lower surface of said leading edge of said frame means, said float means and said frame means being free of interacting fasteners whereby said frame means and said net can easily be lifted upwardly from said float means while said float means continues to float on said water, and said longitudinal floats and said elongated members leaving the front and the top of said open rectangular area substantially unobstructed at all times to permit unobstructed entry of said floating debris into, and to permit the unobstructed substantially-vertical separating movement of said frame means and said net from, said float means, and an elongated floating barrier which is secured to said float means at a point which is displaced outwardly of said one elongated float and hence is displaced outwardly of said pool wall section, said elongated floating barrier extending forwardly of said float means to guide said debris toward said front of said open rectangular area, and said floating barrier having openings therein to permit water to pass therethrough, whereby water will tend to carry debris into the space between said floating barrier and said pool wall section rather than to be diverted around and past said space.

* * * * *